United States Patent [19]

Miwa et al.

[11] Patent Number: 4,901,699

[45] Date of Patent: Feb. 20, 1990

[54] SYSTEM FOR CONTROLLING A FUEL INJECTION QUANTITY AND METHOD THEREFOR

[75] Inventors: Hiromichi Miwa, Yokohama; Masaaki Uchida; Yoshihisa Kawamura, both of Yokosuka, all of Japan

[73] Assignee: Nissan Motor Company, Limited, Yokohama, Japan

[21] Appl. No.: 216,041

[22] Filed: Jul. 7, 1988

[30] Foreign Application Priority Data

Jul. 10, 1987 [JP] Japan ..... 62-172356

[51] Int. Cl.[4] ..... F02D 5/14

[52] U.S. Cl. ..... 123/478; 123/425

[58] Field of Search ..... 123/478, 492, 425; 73/702

[56] References Cited

U.S. PATENT DOCUMENTS

| | | | |
|---|---|---|---|
| 4,342,230 | 8/1982 | Okamura et al. | 73/702 |
| 4,571,683 | 2/1986 | Kobayashi et al. | 123/492 |
| 4,628,883 | 12/1986 | Kataoka | 123/492 |
| 4,640,249 | 2/1987 | Kawamura et al. | 123/425 |
| 4,660,535 | 4/1987 | Asano | 123/425 |
| 4,705,001 | 11/1987 | Danno et al. | 123/478 |
| 4,751,909 | 6/1988 | Otoba | 123/492 |
| 4,753,206 | 6/1988 | Inoue et al. | 123/478 |
| 4,768,486 | 9/1988 | Koika et al. | 123/478 |

*Primary Examiner*—Raymond A. Neill

*Attorney, Agent, or Firm*—Foley & Lardner, Schwartz, Jeffery, Schwaab, Mack, Blumenthal & Evans

[57] ABSTRACT

A system and method for controlling a fuel injection quantity for an internal combustion engine are disclosed in which upon start of the engine acceleration, a quantity corresponding to an air quantity sucked into an engine cylinder (for example, a pressure in an intake air passage downstream of a throttle valve) is detected, an indicated mean effective pressure ($P_i$) is detected, gains and phases of both detected values are matched with each other, respectively, so that an expected value of the indicated mean effective pressure is derived from the detected value of the air quantity corresponding quantity, a deviation between the expected value and detected value of the indicated mean effective pressure is derived, a correction quantity for a basic injection quantity at the time of an acceleration of a vehicle through the engine is derived on the basis of the deviation, and a fuel injection quantity outputted from a fuel injection valve is determined on the basis of the corrected fuel injection quantity.

18 Claims, 9 Drawing Sheets

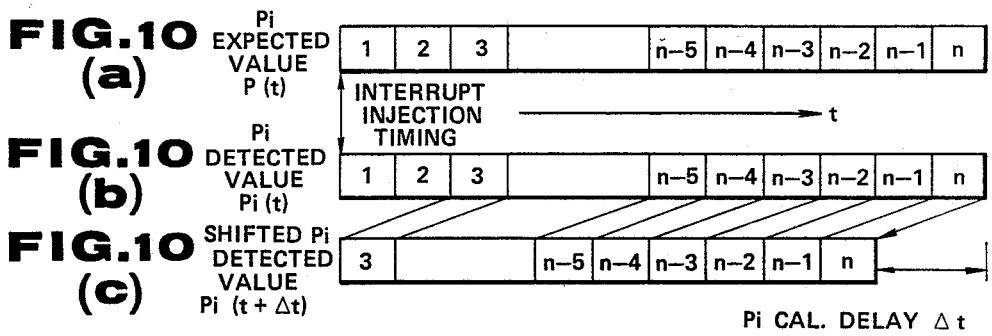
FIG.11
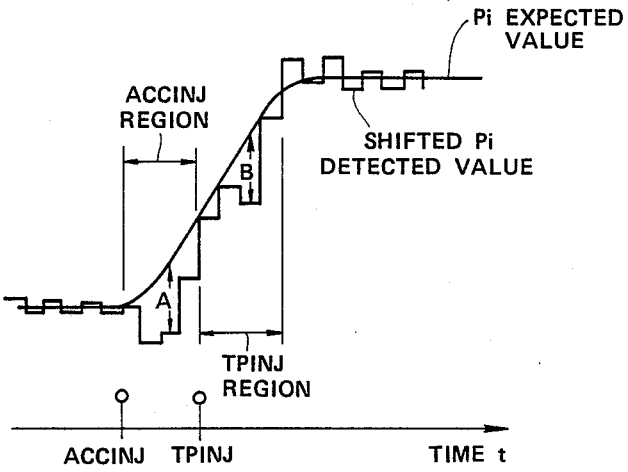

SYSTEM FOR CONTROLLING A FUEL INJECTION QUANTITY AND METHOD THEREFOR

BACKGROUND OF THE INVENTION (1) Field of the Invention

The present invention relates to a system and method for controlling fuel injection quantities applicable to an internal combustion engine. The present invention particularly relates to the system and method for controlling a corrected fuel injection quantity at a time when the engine is accelerated irrespective of a synchronization injection of fuel executed in synchronization with an engine revolution.

(2) Background of the art

A fuel supply controlling system which executes injection of fuel whenever there is a request of acceleration of a vehicle through an engine irrespective of engine revolutions to improve a driveability of the vehicle during the acceleration. (Refer to page 113 of Vol. 35, No. 1 of automotive engineering published by a Tetsudo Nippon Sha on January, 1986.)

In the above-described fuel supply controlling system, since the fuel is to be supplied in a fastest response to the request of the acceleration, the fuel injection is to be executed immediately when there is the request of acceleration of the vehicle without waiting for the timing at which the synchronization injection is executed.

Such an injection method as described above is called an interrupt injection during the acceleration since the injection interrupts the normal synchronization injection of fuel. This is also simply referred to as an interrupt injection.

For example, when an iding contact of a throttle switch associated with a throttle valve is turned from an on state to an off state or a change rate of a basic pulse-width $Tp$ ($=K\times Q_a/N$, wherein K denotes a constant, $Q_a$ denotes an intake air quantity, and N denotes a number of engine revolutions per unit time) per time exceeds a reference level, the interrupt injection is executed. The injection of the former is called an off idle interrupt and the latter injection is called $T_p$ change rate interrupt injection.

A fuel quantity of the interrupt injection is set according to a driving condition during the determination of acceleration (e.g., the engine revolutions N and engine coolant temperature $T_w$).

Since the interrupt injection has an object to obtain an output increase in the engine according to the acceleration request, the quantity of fuel supply is desirably a value derived according to an output variable of the engine.

However, since the interrupt quantity of fuel derived from the above-described system is calculated from the engine revolution numbers N and coolant temperature $T_w$ by referring to a table having parameters of the engine revolution speed and engine coolant temperature, the output increase of the engine due to the interrupt injection does not always exactly correspond to the desired engine output increase. Although the same interrupt injection quantity is to be supplied, the actual fuel quantity supplied in each cylinder becomes different due to the presence of insufficient flow within an injection valve(s) and/or of dirt adhered onto an intake air passage. In addition, a combustion pressure becomes different as a cylinder cooling efficiency becomes different even though the same fuel injection quantity is sucked from the injection valve into each cylinder. Hence, only the actual combustion of fuel reveals whether a previously set output of the engine is achieved.

To cope with different characteristics of the engine, the control is fedback and a target value of a controlled variable should be a variable corresponding to the output of the engine, for example, an indicated mean effective pressure $P_i$.

SUMMARY OF THE INVENTION

It is an object of the present invention to provide a system which accurately controls the fuel injection quantity sufficiently corresponding to the increase of engine output required during an engine acceleration, following a request for acceleration of the engine.

The above-described object can be achieved by providing a system for controlling a fuel supply for an internal combustion engine, comprising: (a) first means for detecting an engine operating condition; (b) second means for determining whether a request to increase an engine output occurs from the detected engine operationg condition; (c) third means for calculating a basic fuel supply quantity for the engine output increase when the second means determines that the request of the engine output increase occurs; (d) fourth means for detecting an input variable for operating the engine which has a close correlation to the engine output; (e) fifth means for detecting an output variable for the engine used for a feedback control variable; (f) sixth means for matching gains and phases between the detected values of the input and output variables of the engine and deriving a target value of the output variable from the detected input variable; (g) seventh means for deriving a deviation between the target value and detected value of the output variable; (h) eighth means for calculating a correction quantity of fuel supply for the basic supply quantity calculated by the third means on the basis of the deviation calculated by the seventh means; and (i) ninth means for correcting the basic quantity of fuel supply on the basis of the correction quantity derived by the eighth means so that the detected output variable coincides with the detected output variable and outputting the corrected quantity of fuel supply as an output quantity of fuel supply to the engine.

The above-described object can also be achieved by providing a system for controlling a fuel injection quantity for an internal combustion engine, comprising: (a) first means for detecting an engine operating condition; (b) second means for determining whether an engine acceleration is carried out on the basis of the detected engine operating condition; (c) third means for calculating a basic injection quantity for an acceleration correction when the second means determines that the acceleration is carried out: (d) fourth means for detecting a quantity corresponding to an air quantity sucked into an engine cylinder; (e) fifth means for detecting an indicated mean effective pressure of the engine cylinder; (f) sixth means for matching gains and phases of both detected values of the air quantity corresponding quantity and of the indicated mean effective pressure and calculating an expected value of the indicated mean effective pressure from the detected value of the air quantity corresponding quantity; (g) seventh means for calculating a deviation between the expected value and detected value of the indicated mean effective pressure;

(h) eighth means for calculating a correction quantity for the basic injection quantity for the acceleration correction on the basis of the deviation calculated by the seventh means; and (i) ninth means for correcting the basic injection quantity for the acceleration correction on the basis of the calculated correction quantity to derive an output injection quantity for the acceleration correction.

The above-described object can also be achieved by providing a method for controlling a fuel injection quantity, comprising the steps of: (a) detecting an engine operating condition; (b) determining whether the engine is accelerated from the detected engine operating condition; (c) calculating a basic injection quantity for an acceleration correction determined in the step (b); (d) detecting a quantity corresponding to an air quantity sucked intoi an engine cylinder; (e) detecting an indicated mean effective pressure of the engine cylinder; (f) matching both gains and phases of the detected values of the air quantity corresponding quantity and of the indicated mean effective pressure to derive a target value of the indicated mean effective pressure from the detected value of the air quantity corresponding quantity; (g) calculating a deviation between the target value and detected value of the indicated mean effective value; (h) calculating a correction quantity for the basic injection quantity for the acceleration correction on the basis of the deviation calculated by the seventh means; (i) correcting the basic injection quantity for the acceleration correction on the basis of the calculated correction quantity to derive an output injection quantity for the acceleration correction.

BRIEF DESCRIPTION OF THE DRAWINGS

FIGS. 10(*a*) to 10(*c*) are graphs for explaining a phase matching $P_i$ detection value with the boost pressure with a calculation delay of the $P_i$ detected value taken into account.

FIG. 11 is a waveform chart for explaining an operation of the preferred embodiment shown in FIG. 1 to 10.

DETAILED DESCRIPTION OF THE PREFERRED EMBODIMENT

Reference will hereinafter be made to the drawings in order to facilitate understanding of the present invention.

Figure 1:
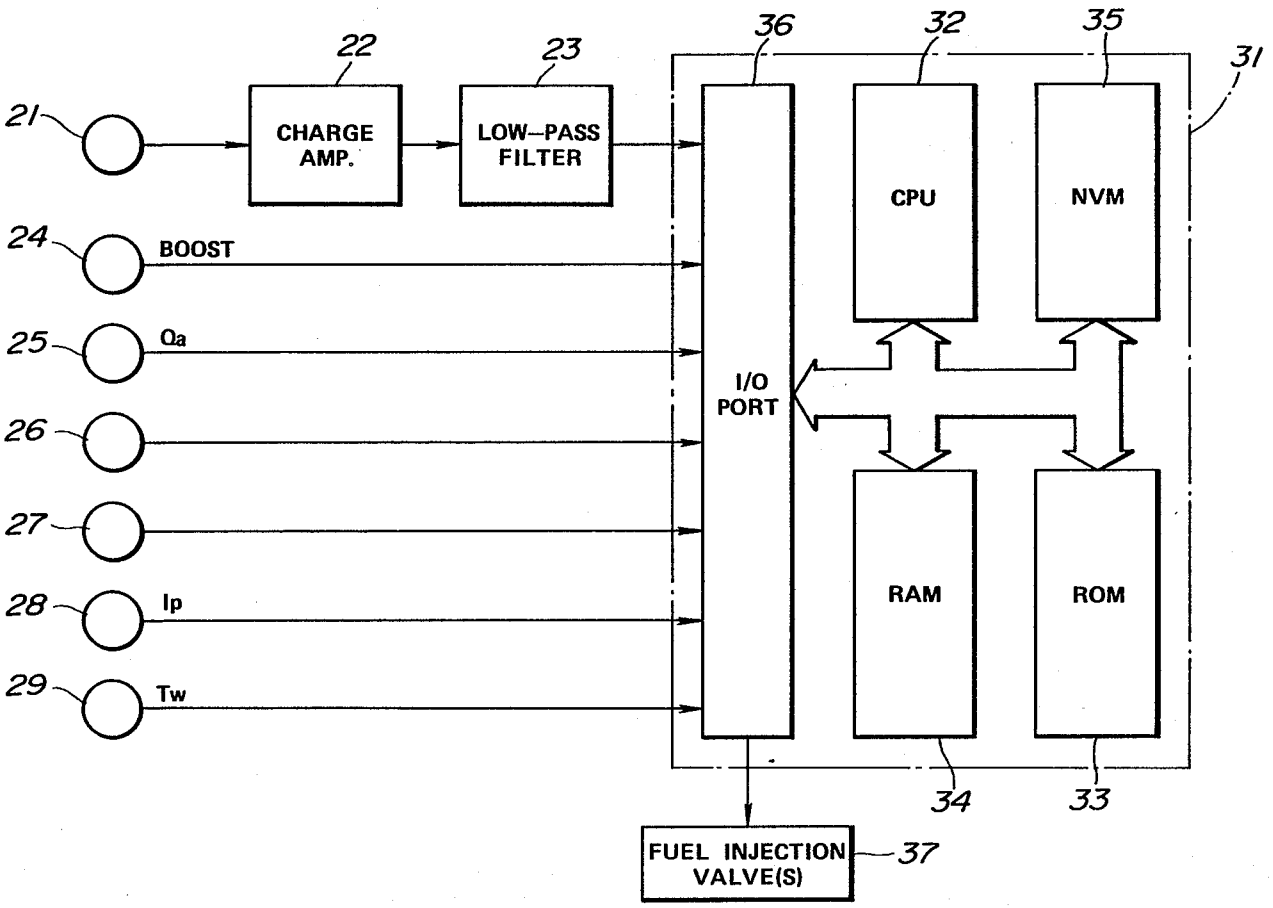
FIG. 1 is a circuit block diagram of a system for controlling a fuel injection quantity in a preferred embodiment according to the present invention.

FIG. 1 shows a block diagram of a preferred embodiment of an engine fuel injection quantity controlling system according to the present invention.

An internal pressure responsive sensor 21 (hereinafter referred to as a pressure sensor) is mounted on a washer section of an ignition plug for generating a quantity of electric charge according to a cylinder internal pressure. An output signal of the pressure sensor 21 is supplied to an I/O port (I/O) 36 via a charge amplifier 22 and low-pass filter 23. The structures of the pressure sensor 21 and charge amplifier 22 are exemplified by U.S. Pat. Nos. 4,640,249 and 4,660,535. The disclosed contents thereof are hereby incorporated by reference. It is noted that an indicated mean effective pressure ($P_i$) is calculated from the output signal of the pressure sensor 21. It is also noted that the pressure sensor 21 may be installed on each engine cylinder, the output signal of each pressure sensor being selected by means of a multiplexer.

A boost pressure sensor 24 detects an intake air passage pressure (so called, boost pressure) at a downstream of a throttle valve. The boost pressure (BOOST) value detected by the pressure responsive sensor 24 is treated as a quantity corresponding to an air quantity sucked into a (or each) cylinder. The structure of the boost pressure sensor 24 is exemplified by a U.S. Pat. No. 4,342,230 issued on Aug. 3, 1982, the disclosure of which is hereby incorporated by reference.

A sensor 25 detects an intake air quantity $Q_a$ (e.g., flap type or hot wire type). A sensor 26 detects a unit angle signal indicating a unit angular displacement of a crankshaft and reference position signal indicating a reference angular position of the crankshaft. A sensor 29 detects an engine coolant temperature $T_w$. The number of engine revolutions per time minute (RPM) N is measured from the unit angle signal derived by the crank angle sensor 26.

It is noted that a basic pulsewidth $T_p$ calculated by $Q_a$ and $N$ ($=K\times Q_a/N$, wherein K denotes a constant) provides a basic value of the synchronization injection as an engine load corresponding quantity and provides a signal for determining an occurrence of the acceleration.

An idle switch 27 is installed in association with a throttle valve which is turned on when the throttle valve is placed at a fully closed position. The output signal of the idle switch 27 also provides a signal for determination of the vehicle acceleration.

An actual air-mixture ratio sensor 28 detects an air-fuel mixture including a stoichometric air-fuel mixture ratio. It is also noted that a lower level of the output signal from the sensor 28 means that the air-fuel mixture ratio becomes rich.

A control unit generally denoted by 31 receives the output signals of the above-described sensors 21 to 29.

The control unit 31 includes a microcomputer having a CPU (Central Processing Unit) 32, ROM (Read Only Memory) 33, RAM (Random Access Memory) 34, Non-volatile memory (NVM) 35, and I/O Port 36. The control unit 31 calculates an injection pulsewidth to be outputted to a fuel injection valve(s) 37 on the basis of the signals derived from these sensors, converts these received signals into a drive pulse which is outputted at an appropriate timing.

It is noted that the above-described system executes the synchronization injection executed in synthesization with a combustion cycle and executes the interrupt injection carried out only when the request to increase the vehicle speed through the engine occurs. The latter interrupt injection is a subject matter of the present invention.

Figure 2:
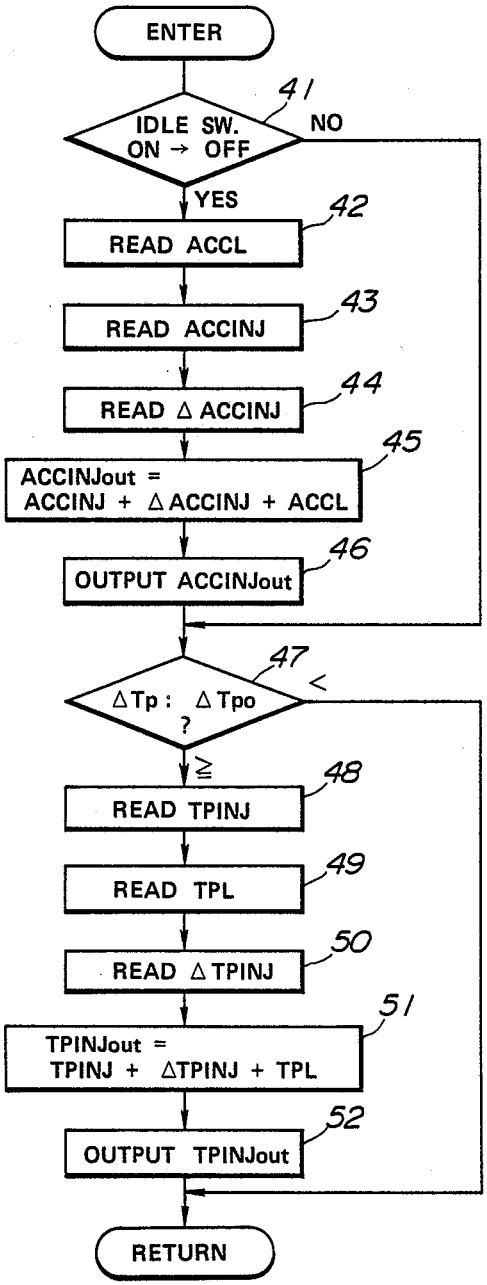
FIG. 2 is an operational flowchart of a main routine in an interrupt injection processing executed in the fuel injection quantity controlling system shown in FIG. 1.

FIG. 2 shows a processing flowchart of a main routine of the interrupt injection.

In FIG. 2, two kinds of interrupt injections are executed. That is to say, steps 41 to 46 denote the off idle interrupt injection processing and steps 47 to 52 denote the interrupt injection processing on change rate of $T_p$. The present invention is applicable to either case.

In FIG. 2, in the step 41, the CPU 32 determines whether the idle switch 27 is turned on or off. When the idle switch is changed from the on state to the off state, the routine goes to a step 42, in which a basic value (ACCINJ) of the off idle interrupt injection quantity is calculated. On the other hand, in the case of the $T_p$ change rate interrupt injection processing, in the steps 47 and 48, when the change rate ($\Delta T_p$) of the basic pulsewidth $T_p$ per unit time exceeds a predetermined value ($\Delta T_{po}$), a basic value (TPINJ) is calculated. It is noted that the values of ACCINJ and TPINJ are stored in the ROM 33 as a table value with N and $T_w$ being parameters and are read in the CPU 32 according to the instantaneous values of sensor outputs of N and $T_w$.

It is noted that since the controlling system cannot cope with variations of the individual engines if the interrupt injection is carried out using directly the values of ACCINJ and TPINJ, these values are diviated from the set values as described above.

In this example, to render the control in a closed loop, a correction quantity for each interrupt injection, i.e., a feedback quantity is introduced. In the steps 44 and 50, the feedback quantity is a value denoted by Δ attached to the basic values (ACCINJ and TPINJ). Symbol Δ means the correction quantity of each interrupt injection.

In the steps 45 and 51, each interrupt injection quantity (ACCINJout and TPINJout) to be outputted is given as the sum of the basic value and feedback quantity. It is noted that symbol out attached to the basic values denotes the output value.

The feedback quantity is derived in the following way.

Since the object of the interrupt injection is to derive speedily the output increase in response to the acceleration request, the feedback quantity is derived from a deviation between a target value and actual value. The target value is a quantity corresponding to an air quantity of engine cylinders having a close correlationship to the engine output, specifically, a value of boost pressure. The actual value is a detection value of the indicated mean effective pressure $P_i$. It is noted that the gain is different between the boost pressure (BOOST) and $P_i$ detection value and $P_i$ detection value has a response delay to BOOST by a calculation delay. Therefore, it is necessary to match both gains and phases with each other, respectively, before deriving the deviation.

Figure 8:
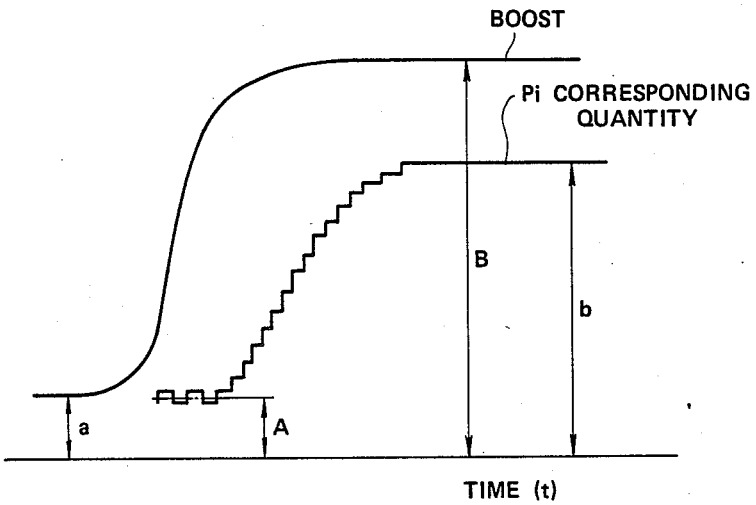
FIG. 8 is a waveform chart of changes in a boost pressure and $P_i$ (indicated mean effective pressure) corresponding quantity.

For the gain matching, suppose that the quantity corresponding to $P_i$ is changed as shown in FIG. 8 when the BOOST is changed during the acceleration as shown in the same drawing.

Figure 9:
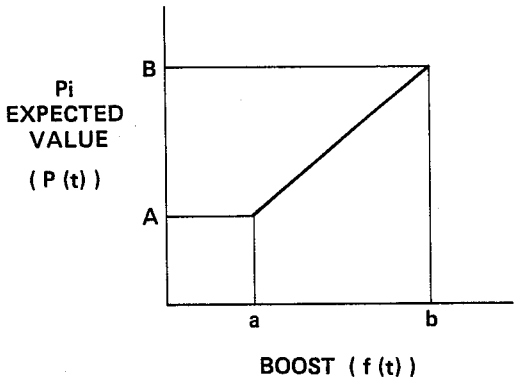
FIG. 9 is a graph for explaining a conversion of the boost pressure into a $P_i$ expected value.

Since each change in BOOST and $P_i$ quantity is a function of time as shown in FIG. 8, suppose that the BOOST change is expressed as the time function of f(t) and the $P_i$ change is expressed as P(t) (provided that there is no consideration of a response delay). In addition, values before and after the acceleration are set as follows.

a : BOOST value before the acceleration
b : BOOST value after the acceleration
A : P(t) before the acceleration
B : P(t) after the acceleration Then, the use of a linear expression approximation permits coincidence of the gain of BOOST and $P_i$ corresponding quantity. The linear expression approximation shown in FIG. 9 is as follows.

$$P(t)=\{(B-A)/(b-a))\}\times f(t)+(A\times b-B\times a)/(b-a)$$

The above-expressed equation means that BOOST can be converted into $P_i$ corresponding quantity.

The $P_i$ corresponding quantity described above is hereinafter referred to as $P_i$ expected value which is oriented as a $P_i$ target value.

Next, the phase matching between the $P_i$ expected value and $P_i$ detection value will be described with reference to FIG. 10.

FIGS. 10(*a*) and 10(*b*) show arrangements of memories in which the $P_i$ expected values and $P_i$ detection values are stored.

As shown in FIGS. 10(*a*) and 10(*b*), numerals have been allocated to each memory location, with the interrupt injection timing as a starting point.

For example, the $P_i$ expected value is stored in the memory location denoted by 1 and is derived from the change in BOOST immediately after the interrupt injection. Since the calculation delay is present in the $P_i$ detection, the location of the memory in which the $P_i$ detection value is stored becomes 3. Hence, a party to be compared with the $P_i$ expected value stored in the memory location of 1 must be the $P_i$ detection value stored in the memory location 3.

As shown in FIG. 10(*c*), if the $P_i$ detection value is shifted by the calculation delay time (Δt), the shifted $P_i$ detection value ($P_i(t+\Delta t)$) corresponds to the $P_i$ expected value.

It is noted that n denotes the total number of memory locations, i.e., stored data, n being based on the number of data covering the single acceleration (for example, the change of boost pressure by a predetermined rate). A single acceleration change requires that number of data.

In the way described above, both the gain matching and phase matchings on the boost pressure (BOOST) and $P_i$ detection values are ended, the normal feedback control technique is used for a subsequent technique of control.

Figure 3:
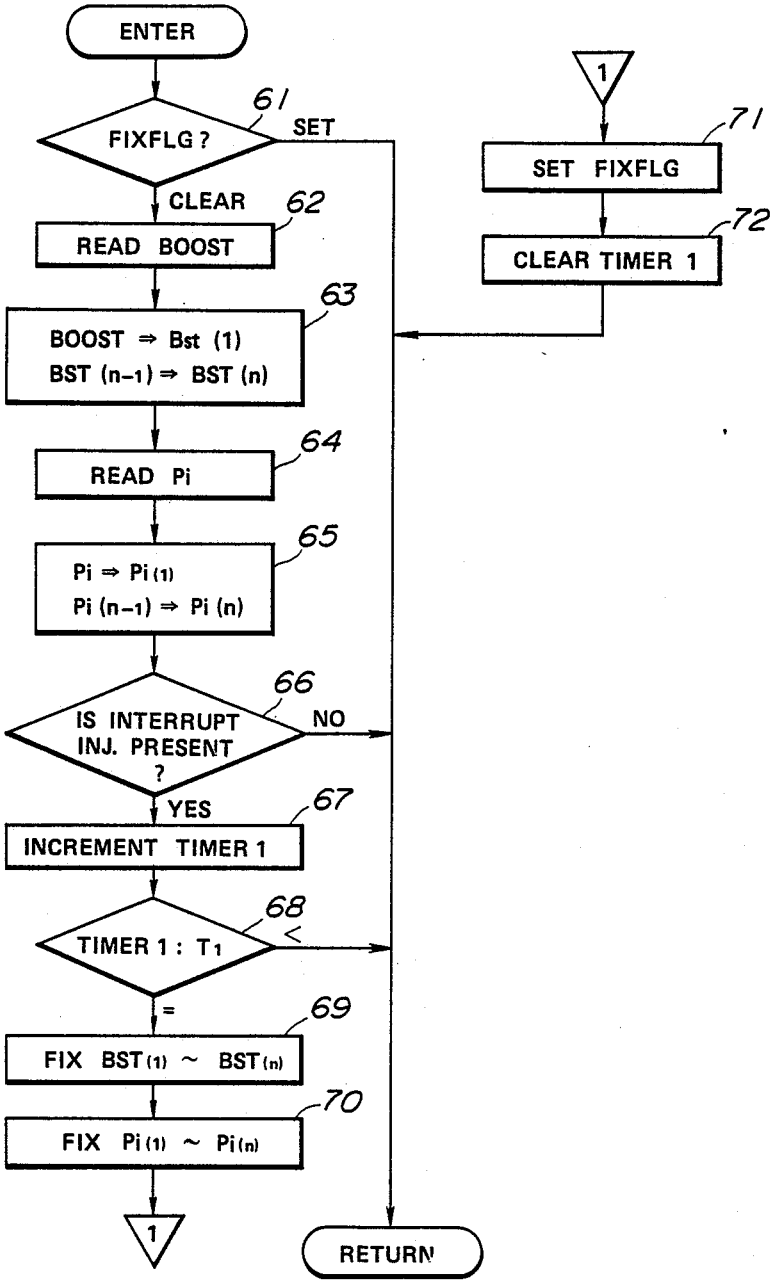
FIG. 3 is an operational flowchart of a routine of processing data executed in the fuel injection quantity controlling system shown in FIG. 1.

FIG. 3 shows a processing flowchart of the interrupt injection for fixing the BOOST and $P_i$ detection value. The reason for the fixing these values is to define the data during the acceleration.

In the routine shown in FIG. 3, the BOOST is read at a time of acceleration and stored in one of the memory locations at a predetermined timing (steps 62 and 63).

This is because n numbers of data shown in FIGS. 10(*a*) to 10(*c*) is obtained.

For example, (i) at the initial timing, the value of BOOST at that time is stored in memory location BST(1).

(ii) at the subsequent timing, the value of BOOST at that time is stored in BST (1). At this time, also the memory value which has been stored in the BST(1) is shifted to the adjacient memory location BST(2).

(iii) at the next timing, the value of BOOST at that timing is stored in BST(1). At this time, the memory values of BST(1) and BST(2) are shifted into the adjacient BST(2) and BST(3), respectively.

(iv) when such a repetition as described above is carried out totally n number of times, the data required during the single acceleration are all stored (step 63).

(v) This is the same as the $P_i$ detection value (steps 64 and 65).

Steps 62 to 65 are executed after the interrupt injection is carried out.

In this case, the n number of data are fixed upon the end of acceleration in steps 66 to 70 and a flag indicating the completion of fixing is set (FIXFLG) in a step 71. Hence, after the FIXFLG is set, the routine does not go to the step 62 and its subsequent steps. in a step 61.

As a reference value $T_1$ determining the timing for the fixing in a step 68, a value of time from the interrupt injection to the acceleration end is specified with the delay time taken into consideration.

Figure 4:
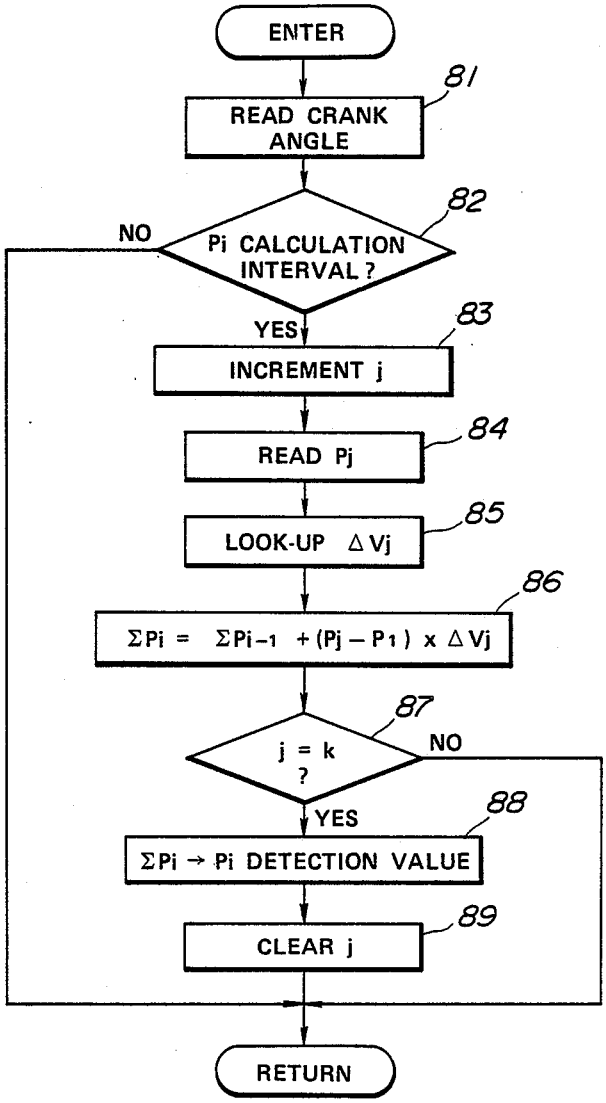
FIG. 4 is an operational flowchart of a routine for processing data executed in the fuel injection quantity controlling system shown in FIG. 1.

FIG. 4 shows a processing routine to execute an arithmetic operation of the $P_i$ detection value. In FIG. 4, the interval $P_i$ is adopted. The interval $P_i$ denotes the indicated mean effective pressure derived from the data of the internal cylinder pressure during a predetermined crank angle interval before and after an upper dead center in a compression stroke. It is noted that the indicated means effective pressure is a value of a total workload of the interval subtracted by a cylinder volume V. Since V denotes a constant, the total workload of the interval may be adopted as the interval $P_i$.

Therefore, in the routine shown in FIG. 4, the total workload of the interval is derived.

For example, the predetermined crank angle interval before and after the upper top dead center in the compression stroke is divided into the totally k numbers for each predetermined crank angle. If the internal cylinder pressures in a j order (j=1 to k) and change rate of cylinder volume change rate ($\Delta V$) are denoted by $p_j$ and $\Delta V_j$, $(P_j-P_1)\times\Delta V_j$ gives a minute workload in the j order. Therefore, if the total workload of the interval is derived by accumulating $(P_i-P1)\times\Delta V_j$ over the predetermined crank angle interval.

That is to say, if the accumulated value of the minute workload is $\Sigma P_i$, the accumulated value of the minute workload upto the j order is derived from the following equation.

$$\Sigma P_i=\Sigma P_{i-1}+(P_j-P_1)\times\Delta V_j$$

$\Sigma P_i$ at the time when j=k gives the total workload of the interval in steps 82 to 88. It is noted that −1 attached to $\Sigma P_i$ and expressed in the above-expressed equation denotes a previous value. It is also noted that a value of an incremental counter is used as j in steps 83 and 89.

Figure 5:
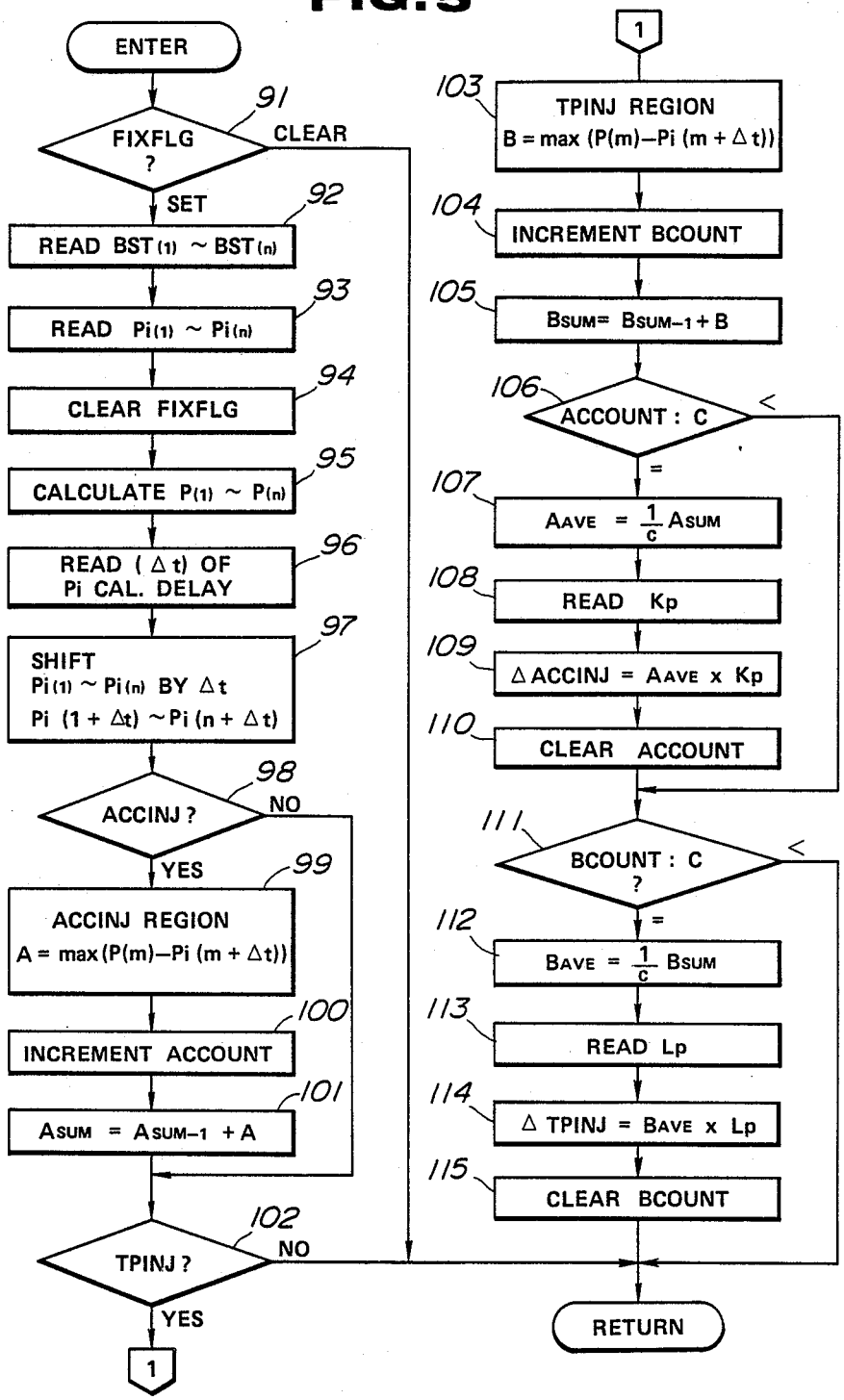
FIG. 5 is an operational flowchart of a routine for processing data executed in the fuel injection quantity controlling system shown in FIG. 1.

FIG. 5 shows a processing routine for calculating the $P_i$ expected value and each feedback quantity based on the deviation between the $P_i$ expected value and $P_i$ detection value.

Upon confirmation that the flag FIXFLG is set, the group of data of the fixed BOOST and $P_i$ detection value (BST(1) to BST(n) and P(1) to $P_{i(n)}$) is read. Numerical values (a,b,A,B) shown in FIGS. 8 and 9 are used from among the data group of BOOST to calculate the $P_i$ expected value (P(1) to P (n)). As shown in FIG. 10, the $P_i$ detection value is shifted by the delay ($\Delta t$) of the $P_i$ calculation as described in FIG. 10 in steps 91 to 97.

(P(m)), i.e., the m order $P_i$ expected value-stop (m=1 to n) corresponds to (m+$\Delta$t) order ($P_i$ (m+$\Delta$t)) from among the shifted $P_i$ expected values.

Hence, the deviation between both $P_i$ values is expressed as (P(m)−$P_i$ (m+$\Delta$t)), the feedback quantity (deviation$\times K_p$ if the proportional control is present) from the deviation and control gain (e.g., the proportional gain $K_p$) is determined.

Since the n number of deviations are determined as the n number of data group taken into account, the maximum deviation is adopted in this embodiment and the deviation is an average value of the maximum deviation derived during the predetermined number of accelerations. The reason for the average value is that the derived $P_i$ detection value changes due to the difference in the cycle position in which the interrupt injection is carried out.

For example, when the maximum deviation (A) is selected from the deviation in the case of the off idle interrupt injection, A is accumulated, and a value of a counter (ACOUNT) for counting the number of times the A is derived reaches the predetermined value (C), the average value ($A_{AVE}$) is calculated from the accumulated value (ASUM) of A in the following way in steps 98 to 101, 106, and 107.

$$A_{AVE}=(1/C)ASUM$$

It is noted that the maximum value A of the deviation is expressed in a step 99 as follows.

$$A=\max(P(m)-P_i(m+\Delta t))$$

In addition, ASUM is derived as follows.

$$ASUM=ASUM_{-1}+A \text{ (step 101)}$$

In steps 108, 109, the feedback quantity of the interrupt injection ($\Delta$ACCINJ) is thus derived using the proportional gain $K_p$ as follows.

$$\Delta ACCINJ=A_{AVE}\times K_p$$

$K_p$ is set so as to become greater as the value of $A_{AVE}$ becomes greater. It is noted that $\Delta$ACCINJ corresponds to a proportional function in a, so called, proportional control.

On the other hand, for the $T_p$ change rate interrupt injection, there is no difference from that of the offidle interrupt injection. If A is replaced with B and $K_p$ is replaced with $L_p$, the feedback quantity $\Delta$TPINJ is derived as follows in steps 102 to 105 and 111 to 115.

$$\Delta TPINJ=B_{AVE}\times L_p$$

If the boost pressure is used as the target value, the boost pressure corresponding to the cylinder air quantity which has the strong corelationship to the output power, the boost pressure then corresponds well to the output power increase.

In addition, the $P_i$ detection value is used as the feedback signal, and the $P_i$ expected value is introduced for gain matching with the $P_i$ detection value and phase matching between the $P_i$ expected value and $P_i$ detection value with the calculation delay. Therefore, the accurate determination of the feedback quantity can be achieved and control accuracy is improved.

It is noted that by using the feedback control the deviation from the set value due to variations in the engine can be eliminated.

The acceleration time includes the cases where only off idle interrupt injection is executed and where both the off idle interrupt injection and $T_p$ change rate interrupt injection are continously executed in a very short period of time. Therefore, it is desirable to add a learning function to the control in order not to reduce the control accuracy.

Learning values ACCL and TPL for the respective interrupt injections are introduced in steps 43 and 49 in FIG. 2.

$$ACCINJ_{out}=ACCINJ+\Delta ACCINJ+ACCL$$

$$TPINJ_{out}=TPINJ+\Delta TPINJ+TPL$$

In the way described above, the pulsewidths of the interrupt injections are determined in steps 45 and 51.

Figure 6:
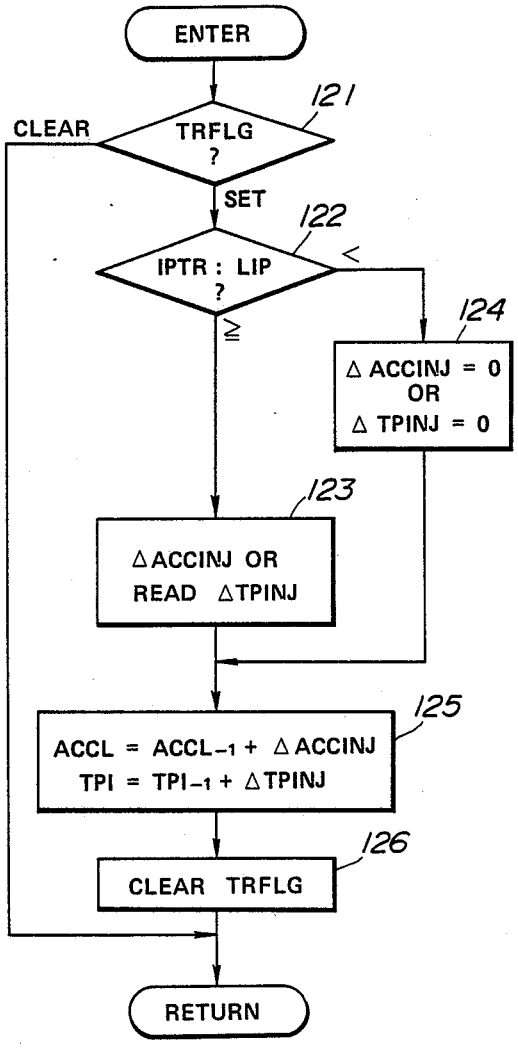
FIG. 6 is an operational flowchart of a processing routine executed in the fuel injection quantity controlling system shown in FIG. 1.

FIG. 6 shows an arithemetic operation processing routine of each learning value.

If a condition to carry out the learning is established, each learning value (ACCL and TPL) is derived using each feedback quantity (ΔACCINJ and ΔTPINJ) at the present time and each learning value at the previous time ($ACCL_{-1}$ and $TPL_{-1}$) is derived in steps 123 and 125.

Although in such an engine as receiving the aging effect in the conventional injection controlling system each interrupt injection is continously executed as shown in FIG. 11 when an abrupt acceleration is carried out from a state in which the throttle valve is fully closed, the $P_i$ detection value in every interrupt injection region does not often reach the $P_i$ expected value. In this case, in a ragion where the $P_i$ detected value is considerably below the $P_i$ expected value, the output increase is not expected although the interrupt injection is carried out. This makes the vehicle driver feel unwanted increase in the engine output or a, so called, gasp for breath of the engine although the throttle valve is opened to abruptly accelerate the vehicle.

On the other hand, in the preferred embodiment, the maximum deviations A and B in the respective regions are derived through the feedback control. To prevent the occurrence of such a deviation, the learning is carried out. Therefore, the $P_i$ detection value follows the $P_i$ expected value. This permits the smooth increase of the engine output during the acceleration and enjoys a pleasant response according to the abrupt acceleration.

Figure 12:
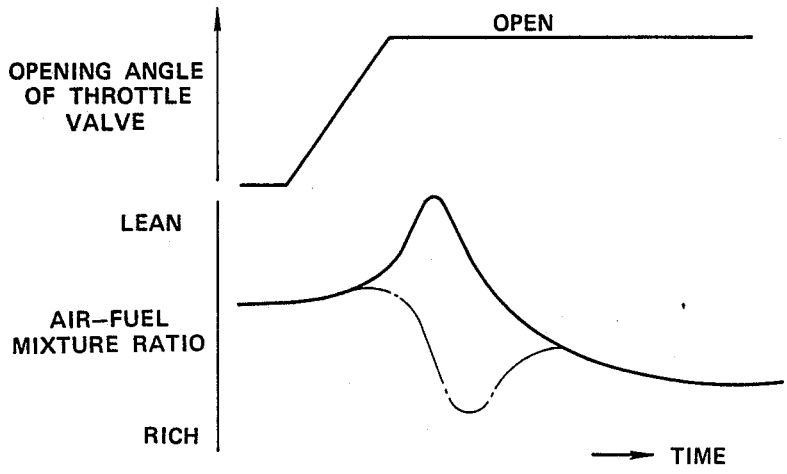
FIG. 12 is a waveform chart for explaining a change of air-fuel mixture ratio during an acceleration operation of the engine in a previously proposed fuel injection controlling system.

Next, in a case where the $P_i$ detection value is reduced from the $P_i$ expected value, such a case includes the air-fuel mixture ratio as shown in FIG. 12 which becomes lean from the set value (as denoted by a solid line) and that as shown in FIG. 12 which becomes rich (as denoted by a dot-and-dash line). Therefore, it becomes necessary to take the relationship to the exhaust performance into account if the air-fuel mixture becomes rich. For example, if a rich misfire occurs, the exhaust emission becomes worsened.

In the preferred embodiment, the learning is inhibited in a case where the sensor output of the air-fuel mixture sensor indicates that the air-fuel mixture becomes rich exceeding a limit value.

Figure 7:
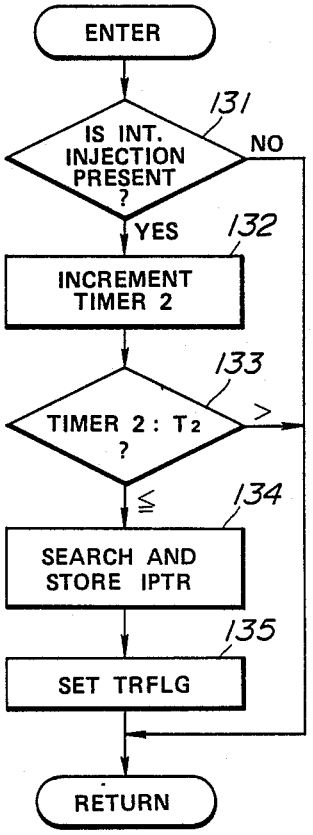
FIG. 7 is an operational flowchart of a processing routine executed in the fuel injection quantity controlling system shown in FIG. 1.

For example, FIG. 7 shows a routine of detecting the air-fuel mixture carried out after the acceleration is carried out.

After the interrupt injection is carried out, the sensor output value is sampled for each predetermined crank angle. Then, a minimum value (IPTR) is selected from among the sampling data and stored in the memory (steps 132 to 134). The reason that the minimum value is selected means that as the sensor output value becomes smaller the air-fuel mixture becomes rich. In addition, an interval ($T_2$) for which the sampling is carried out is determined with an exhaust repsonse delay taken into account. Finally, the flag (TRFLG) indicating that the storage of the minimum value is ended is set (step 135).

On the other hand, at the start of the learning routine shown in FIG. 6, the control unit 31 sets as the learning conditions such that (i) TRFLG is set and (ii) IPTR exceeds the limit value (LIP) at the rich side of the air-fuel mixture ratio in steps 121 and 122.

Since the learning is not carried out in cases where the air-fuel mixture ratio becomes rich so as to exceed the limit value in steps 122 and 124, the exhaust emission due to the occurrence of rich misfire is not worsoned.

In the pereferred embodiment, the proportional control has been described as the feedback control mode. However, any other control except the proportional control can be used. In addition, $Q_a$ and $T_p$ can be used in place of the boost pressure. However, these values are accompanied with the response delay with respect to the cylinder air quantity in the normal cases. It is necessary to carry out the compensation for the response delay.

However, it is cost effective since no boost pressure sensor is required. Furthermore, although, in the preferred embodiment, the acceleration interrupt injection is described, the present invention is applicable to a correction quantity for the normal injection during the acceleration.

As described hereinabove, the fuel injection quantity controlling system and method according to the present invention carries out the feedback control with the variable corresponding to the cylinder air quantity which has the close correlationship to the engine output as a target value in the interrupt injection, introduces the expected value of the indicated mean effective pressure when the detection value of the indicated mean effective pressure is used as the feedback signal, and matches the gains and phases between the expected value and the detection value. Therefore, the system and method according to the present invention sufficiently correspond to the output increase required during acceleration and control accuracy can be improved.

It will fully be understood by those skilled in the art that the foregoing description is made in terms of the preferred embodiment and various changes and modifications may be made without departing from the scope of the present invention which is to be defined by the appended claims.

What is claimed is:

1. A system for controlling a fuel supply for an internal combustion engine, comprising:

(a) first means for detecting engine operating conditions;
(b) second means for determining whether a request to increase an engine torque occurs from said first means;
(c) third means for calculating a basic fuel supply quantity to be supplied when the second means determines that the request of the engine torque increase occurs;
(d) fourth means for detecting from said first means a detected variable which has a close correlation to the engine power output;
(e) fifth means for calculating from said first mean an expected variable which has a close correlation to the engine power output;
(f) sixth means for matching gains and phases between said fourth means detected value and said fifth means expected value;
(g) seventh means for deriving from the sixth means a basic fuel supply correction quantity;
(h) eighth means for calculating a learning value based upon said basic fuel injection correction quantity of the seventh means; and
(i) ninth means adding said third means basic fuel supply quantity, seventh means basic fuel supply correction quantity, and eighth means learning value and for outputting a quantity of fuel to the engine based upon the result.

2. A system for controlling a fuel injection quantity for an internal combustion engine, comprising:
(a) first means for detecting engine operating conditions;
(b) second means for determining whether an engine acceleration is carried out on the basis of said first means;
(c) third means for calculating a basic injection quantity when the second means determines that acceleration occurs;
(d) fourth means for detecting air quantity sucked into an engine cylinder;
(e) fifth means for detecting an indicated mean effective pressure of the engine cylinder;
(f) sixth means for matching gains and phases of both detected values of the air quantity and of the indicated mean effective pressure and calculating an expected value of the indicated mean effective pressure therefrom;
(g) seventh means for calculating a deviation between the expected value and detected value of the indicated mean effective pressure;
(h) eighth means for calculating a correction quantity for the basic injection quantity on the basis of the deviation calculated by the seventh means; and
(i) ninth means for correcting the basic injection quantity on the basis of the calculated correction quantity of the eighth means to derive an output injection quantity.

3. A system as set forth in claim 2, wherein the fourth means includes tenth means for detecting a boost pressure of the cylinder.

4. A system as set forth in claim 3, wherein the sixth means derives the boost pressure before and after the acceleration is carried out and the indicated mean effective pressures so that both gains are matched to derive the expected value of the indicated mean effective pressure.

5. A system as set forth in claim 4, wherein the sixth means shifts the value of the indicated mean effective pressure by a time corresponding to a delay required for the detection of the indicated mean effective pressure so as to match the phase of the indicated mean pressure with that of the detected boost pressure.

6. A system as set forth in claim 5, wherein the fifth means includes eleventh means for detecting an inner pressure of the cylinder within a predetermined crank angle range before and after a top dead center in a compression stroke of the cylinder and calcualting the indicated mean effective pressure using an equation expressed as follows:

$$\Sigma P_i = \Sigma P_{i-1} + (P_j - P_1) \times \Delta V_j$$

wherein $\Sigma P_i$ denotes an accumulated value of a minute workload, $j = 1 - k$, $\Delta V_j$ denotes a change rate of a cylinder volume, and $\Sigma P_{i-1}$ denotes the accumulated value of a previous minute workload.

7. A system as set forth in claim 6, wherein the seventh means calculates the deviation in such a way that a maximum deviation in a single acceleration is derived from an n number of data on the deviations, n being the number of data on the deviation for covering the single acceleration, and an average value of the maximum deviations for a predetermined number of times the acceleration is carried out is derived.

8. A system as set forth in claim 7, wherein the eighth means calculates the correction quantity from the average value of the maximum deviations derived by the seventh means multiplied by a control gain.

9. A system as set forth in claim 8, wherein the ninth means derives the output injection quanitity from the basic injection quantity plus the average value of the maximum deviations multiplied by the control gain and plus a learning value of the output injection quantity.

10. A system as set forth in claim 9, which further comprises twelfth means for detecting an air-fuel mixture ratio for each predetermined crank angle after the fuel injection for the acceleration correction is carried out, thirteenth means for selecting a minimum value of the sampled data derived by the twelfth means; fourteenth means for determining whether the minimum value of the sampled data indicates a richer air-fuel mixture ratio than a limit value; and fifteenth means for inhibiting the adoption of the learning value fro the output injection quantity derived by the ninth means when the fourteenth means determines that the minimum value indicates the richer air-fuel mixture ratio exceeds the limit value.

11. A system as set forth in claim 10, wherein a sampling interval of the twelfth means is determined with an exhaust response delay taken into account.

12. A system as set forth in claim 2, wherein the first means comprises tenth means for detecting an engine speed and eleventh means for detecting an engine coolant temperature and the third means calculates the basic injection quantity from the detected engine speed and engine coolant temperature.

13. A system as set forth in claim 12, wherein the first means comprises twelfth means for detecting whether a throttle idle switch which switches off when a throttle valve installed on an intake air passage is opened and wherein the second means determines that the acceleration is carried out and when the twelfth means detects the throttle idle switch is changed from an on state to an off state.

14. A system as set forth in claim 13, wherein the second means determines that the acceleration is carried out when the basic fuel injection quantity exceeds a predetermined value.

15. A system as set forth in claim 2, wherein the ninth means outputs the output injection quantity immediately after the acceleration is carried out without synchronization with the engine revolution.

16. A system as set forth in claim 8, wherein the control gain is a proportional control gain.

17. A system as set forth in claim 2, which further comprises a fuel injection valve located in an intake air passage of the engine for injecting the output fuel injection quantity derived by the ninth means therethrough.

18. A method for controlling a fuel injection quantity, comprising the steps of:

(a) detecting engine operating conditions;

(b) determing whether the engine is accelerated from said first means;

(c) calculating a basic injection quantity for an acceleration correction determined in step (b);

(d) detecting an air quantity sucked into an engine cylinder;

(e) detecting an indicated mean effective pressure of the engine cylinder (f) matching both gains and phases of the detected values of the air quantity and the indicated mean effective pressure to derive a target value;

(g) calculating the deviation between the target value and detected value of the indicated mean effective value;

(h) calculating a correction quantity on the basis of the diviation;

(i) correcting the basic injection quantity for the acceleration correction on the basis of the calculated correction quantity to derive an output injection quantity.

* * * * *